United States Patent [19]

Delaittre

[11] Patent Number: 4,979,880

[45] Date of Patent: Dec. 25, 1990

[54] APPARATUS FOR PUMPING WELL EFFLUENTS

[75] Inventor: Pierre A. M. X. Delaittre, The Hague, Netherlands

[73] Assignee: Shell Oil Company, Houston, Tex.

[21] Appl. No.: 310,150

[22] Filed: Feb. 14, 1989

[30] Foreign Application Priority Data

Feb. 29, 1988 [GB] United Kingdom ..... 8804727

[51] Int. Cl.[5] ..... F04B 17/00

[52] U.S. Cl. ..... 417/406; 417/391; 417/392

[58] Field of Search ..... 417/313, 375, 391, 392, 417/405, 406, 407, 408, 409; 166/265, 267, 268

[56] References Cited

U.S. PATENT DOCUMENTS

| | | | |
|---|---|---|---|
| 2,269,189 | 1/1942 | Downs | 103/5 |
| 2,733,663 | 7/1954 | Marshall | 417/406 |
| 3,171,355 | 3/1965 | Harris | 417/406 |
| 3,261,398 | 7/1966 | Haeber | 166/0.5 |
| 3,536,135 | 10/1970 | Dozier | 166/0.5 |
| 3,627,048 | 6/1970 | Roeder | 166/268 |
| 3,877,520 | 4/1975 | Putnam | 166/0.6 |
| 4,003,678 | 1/1977 | David | 417/88 |
| 4,086,030 | 4/1978 | David | 417/88 |
| 4,264,285 | 4/1981 | Erickson et al. | 417/405 |
| 4,292,011 | 9/1981 | Erickson . | |
| 4,712,984 | 12/1987 | Lepert | 417/406 |

FOREIGN PATENT DOCUMENTS

| | | |
|---|---|---|
| 0236166A1 | 9/1987 | European Pat. Off. . |
| 3026855A1 | 12/1981 | Fed. Rep. of Germany . |

OTHER PUBLICATIONS

"Underwater Multiphase Pumps: The Key to Subsea Production", World Oil, Dec. 1987, pp. 54–55.

*Primary Examiner*—Leonard E. Smith
*Assistant Examiner*—John A. Savio, III

[57] ABSTRACT

A fluid motor and rotary pump are arranged in a cylindrical housing which is releasably secured in a cup-shaped base unit so that the housing can be removed from and inserted into the base via the open top.

10 Claims, 3 Drawing Sheets

APPARATUS FOR PUMPING WELL EFFLUENTS

BACKGROUND OF THE INVENTION

The invention relates to an apparatus for pumping effluents from a well or a cluster of wells and for boosting their pressure in order to transfer them to a process facility.

The invention relates more in particular to a pumping apparatus comprising a fluid motor and a rotary pump driven thereby. Fluid driven pumps of this type may be employed to produce hydrocarbons in their natural form from oil fields. These hydrocarbons may contain crude oil, natural gas, water and some solids like sand and salt.

The varying composition and gas content of the pumped well effluents make pumping difficult and it is known from U.S. Pat. No. 2,470,878 and from European patent application No. 87400158.9 (publication No. 0236166, publication date: 9th September, 1987) that it may be advantageous to mix some of the driving liquid with the well effluents in order to increase the liquid content thereof. In view of the harsh operating conditions regular maintenance and inspection of the pumping equipment is required.

If the pump forms part of a pump station at a remote location such as at a subsea wellhead, retrieval of the pump for maintenance or inspection may be a cumbersome and difficult operation.

SUMMARY OF THE INVENTION

Accordingly it is an object of the present invention to provide an apparatus for pumping well effluents which can be easily installed and replaced.

The pumping apparatus according to the invention comprises a cylindrical housing having disposed therein a fluid motor and a rotary pump driven thereby, a vertically oriented cup-shaped base unit in which said cylindrical housing is retrievably secured such that a space is left therebetween, a plurality of sealing means for dividing said space into at least three hydraulically separated sections, a first of said sections providing fluid communication between an end of an effluent feed conduit passing through the wall of said base unit and an effluent inlet of said pump passing through said housing, a second of said sections providing fluid communication between an end of an effluent exhaust conduit passing through the wall of the base unit and an effluent outlet of said pump passing through said housing, and a third of said sections providing fluid communication between an end of a power liquid feed conduit passing through the wall of said base unit and a fluid inlet of said motor passing through said housing.

The arrangement of the fluid motor and rotary pump in a cylindrical housing which is releasably secured in a cup-shaped base unit has the principal advantage that the housing can be easily removed from and inserted into the base via the open top thereof.

It is observed that it is known from U.S. Pat. No. 2,269,189 to arrange a cylindrical pump-driver unit inside a production tubing within a well. A difficulty encountered with the known tool is that it the unit has to be retrieved or replaced the well has to be shut down and the wellhead has to be opened, which is a time consuming and therefore costly operation, in particular for offshore fields. Further disadvantages of the known tool are that it obstructs wireline operations in the well and that the confined space within a well tubing prescribes a small diameter of the unit and therefore a limited pump flow rate. The diameter of the retrievable housing of the apparatus according to the invention, on the other hand, can be tailored to the required size of the rotor of the pump or motor to accomplish an optimum flow rate and hydraulic head. It is preferred to use in the apparatus according to the invention purified water as power liquid. If water injection wells are present in the oil field from which the effluents are produced, the power fluid feed pipe could form part of a water injection system and a fourth section could be present between said base and the cylindrical pump-/motor housing to discharge the water from the outlet of the fluid motor into a power liquid exhaust line which leads to a water injection well. In that case some of the exhaust water from the fluid motor could be mixed up with the well effluents in order to maintain the liquid content thereof at such a level that they remain pumpable by the rotary pump even in case the effluents would occasionally contain 100% gas. Mixing up of purified water with the well effluents has the advantage that it can be easily removed from said effluents in an oil water separator without causing scaling problems in the separator and in other processing equipment.

It is furthermore preferred that said space between the base and pump/driver housing is an annular space which is divided by a series of sealing rings on the cylindrical housing into a series of vertically spaced hydraulically separated sections. In this preferred configuration of the apparatus no longitudinal forces due to fluid pressure of the driving fluid and well effluents are exerted to the retrievable housing so that said housing can be locked to the base unit by a simple mechanical device, and no pressure relief devices are needed to relieve pressure induced longitudinal forces during retrieval of the pump/driver housing from the base unit.

It is furthermore preferred to arrange said annular sections such that the third annular section, in which said power liquid feed pipe discharges, is located above said other sections of said annular space. If in that case water is used as power liquid, a high pressure water jacket is created in said third section which prevents that even if the seals would fail leakage of well effluents into the environment occurs.

BRIEF DESCRIPTION OF THE DRAWINGS

These and other objects and advantages of the apparatus according to the invention will be evident from the following detailed description read in conjunction with the accompanying drawings, in which.

DESCRIPTION OF PREFERRED EMBODIMENTS

Figure 1:
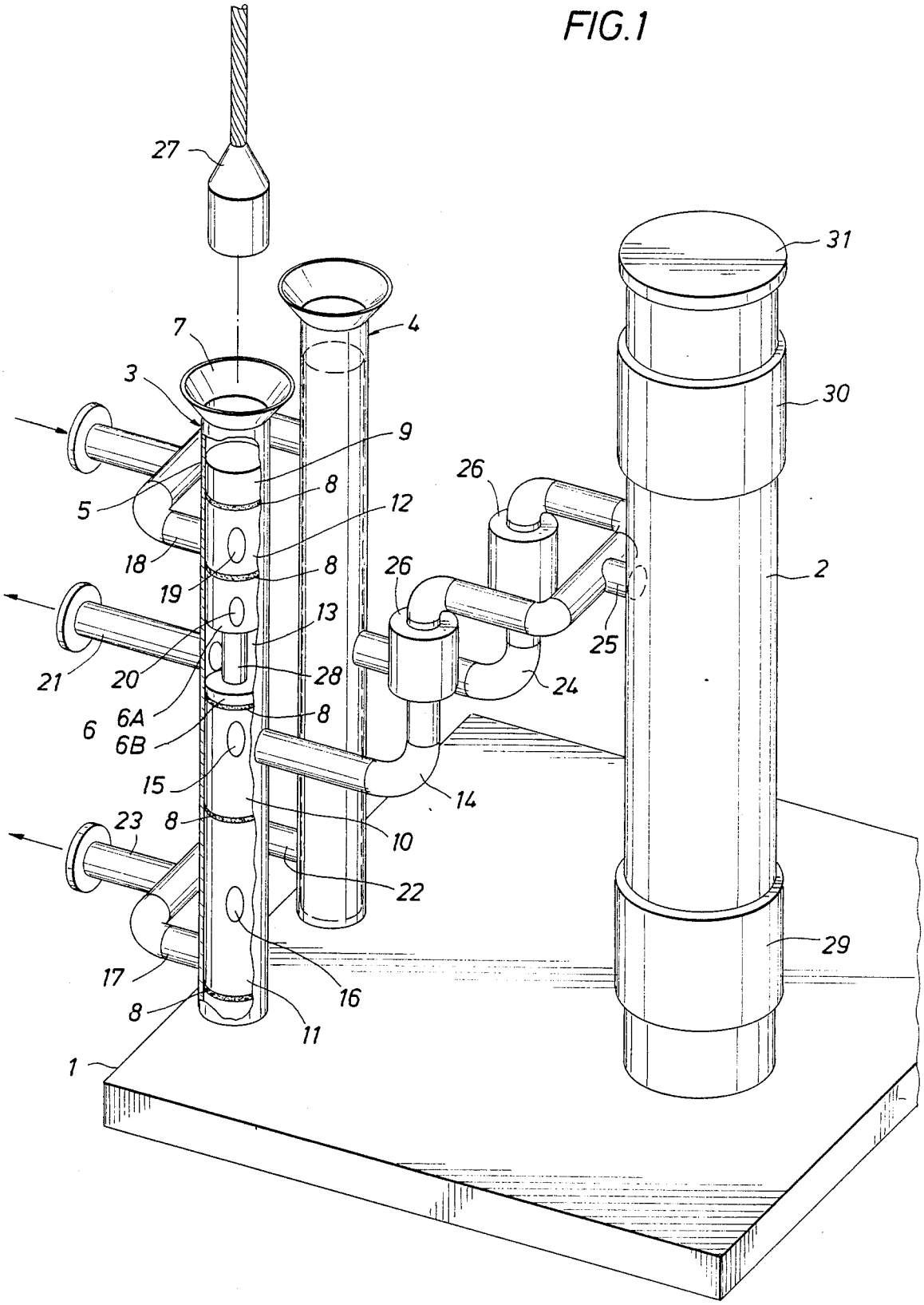
FIG. 1 shows a schematic perspective view of a wellhead on which two pumping apparatuses according to the invention are mounted.

Referring now to FIG. 1 there is shown a subsea wellhead comprising a tree base 1 and a tree 2. Two fluid driven pumping apparatuses according to the invention 3, 4, respectively, are mounted on the tree base 1 adjacent to the tree 2.

The apparatus 3 comprises a cup-shaped base unit 5, which is shown in a partly broken-away view, and a cylindrical housing 6 having disposed therein a fluid motor 6A and a rotary pump 6B driven thereby.

The cup-shaped base unit 5 has a vertical orientation and comprises at the upper end thereof a guide funnel 7 to allow easy insertion of the housing 6 into the base unit 5.

On the outer surface of the cylindrical housing 6 there are mounted five sealing ring units 8 which divide an annular space 9 left between the cylindrical housing 6 and the inner side of the side wall of the cup-shaped base unit 5 into four vertically space and hydraulically separated sections 10, 11, 12 and 13, respectively.

Section 10, the first section of the annular space, provides fluid communication between an end of an effluent feed conduit 14 passing through the wall of the base unit 5 and a fluid inlet 15 of the pump 6B.

Section 11, the second section of the annular space provides fluid communication between an end of an effluent outlet 16 of the pump and an effluent exhaust conduit 17 passing through the wall of the base unit 5. Section 12, the third section of the annular space provides fluid communication between an end of a power liquid feed conduit 18 passing through the side wall of the base unit 5 and a liquid inlet 19 or the motor 6A. Section 13, the fourth section of the annular space, provides fluid communication between a liquid outlet 20 of the motor and a power liquid exhaust conduit 21.

The second pumping apparatus 4 is identical to the first pumping apparatus 3 and as can be seen in the drawing the effluent exhaust conduits 17 and 22 thereof are connected to a common effluent exhaust pipe 23 which may lead to process facilities (not shown) on an offshore platform or other structure or onshore. As can further be seen, the effluent feed conduit 14 of the first pumping apparatus 3 and the effluent feed conduit 24 of the second pumping apparatus 4 are connected to the well tree 2 via a T-joint 25. The effluent feed conduits 14, Z4 comprise each a wing valve 26 for controlling the flow of effluents towards a desired pumping apparatus. The well tree 2 further comprises a master valve 29 which also serves to control the flow of effluents from the well into the apparatuses 3 and 4, and a swab valve 30 which allows removal of the tree cap 31 from the tree 2 without the risk of escape of well effluents into the environment. The power liquid exhaust conduit 21 of the first pumping apparatus 3 may be connected to the power liquid exhaust conduit (not shown) of the second pumping apparatus 4 and may lead to a water injection well (not shown) if water is used as power liquid.

As can be seen in the cut-away view of the apparatus 3, the arrangement of the third section 12 above the other sections 10, 11 and 13 of the annular space has the advantage that if water is used as power liquid a jacket of pressurized water is created in said third section 12 which prevents that even if the seal units 8 would fail well effluents would leak into the environment.

An advantage of the division of the annular space into annular sections 10, 11, 12 and 13 via which the well effluents and power liquid are fed into and discharged from (he apparatus is that during normal use no longitudinal forces due to elevated fluid pressures are exerted to the retrievable cylindrical housing 6. Therefore only a simple mechanical device (not shown), such as a snap-type locking device, is required to lock the housing 6 to the base unit 5 and possibly energize the seal units 8. Moreover, if the housing 6 is to be retrieved from the base unit 5, no pressure relief devices are needed to relieve pressure induced longitudinal forces. Thus it can be seen that the housing 6 can easily be installed in and retrieved from the base unit 5 by means of a simple maintenance or interface tool 27 which can be secured to the upper end of the housing 6 and which, if the apparatus is installed at an underwater location can be diver operated, drill string operated or operated by a remotely operated vehicle (ROV).

It is advantageous that the liquid motor 6A be a turbine, mounted at the same shaft 28 as the pump turbIne 68. In this manner a compact pump-driver unit is created which can be easily installed in and retrieved from the cylindrical housing 6.

To accomplish an acceptable gas/liquid ratio that can be tolerated by the pump 6B, even if the well effluents contain 100% gas, a fluid passage (not shown) is arranged in the housing 6 between the fluid outlet 20 of the motor 6A and the fluid inlet 15 of the pump 6B.

The fluid passage comprises a regulating device which controls the amount of water exhausted from the motor into the pump such that in the normal operating mode when the well effluents comprise only a minor gas ratio, the fluid passage is closed and no water is mixed up with the well effluents, but if incidentally the gas ratio of the well effluents rises such that a proper operation of the pump would be hampered, water is mixed up with the effluents to maintain the gas/liquid ratio at an acceptable value.

During production of well effluents, normally only one pumping apparatus 3 or 4 will be in operation; the second one is started only when the first one fails to operate properly and therefore needs to be replaced. Alternatively, both apparatuses may be in operation simultaneously while they are linked either in parallel or in series to the underwater flowline 23.

As illustrated in FIGS. 2, 3, 4 and 5, there are various possible ways of mixing up part the injection water with the well effluents.

Figures 2, 3:
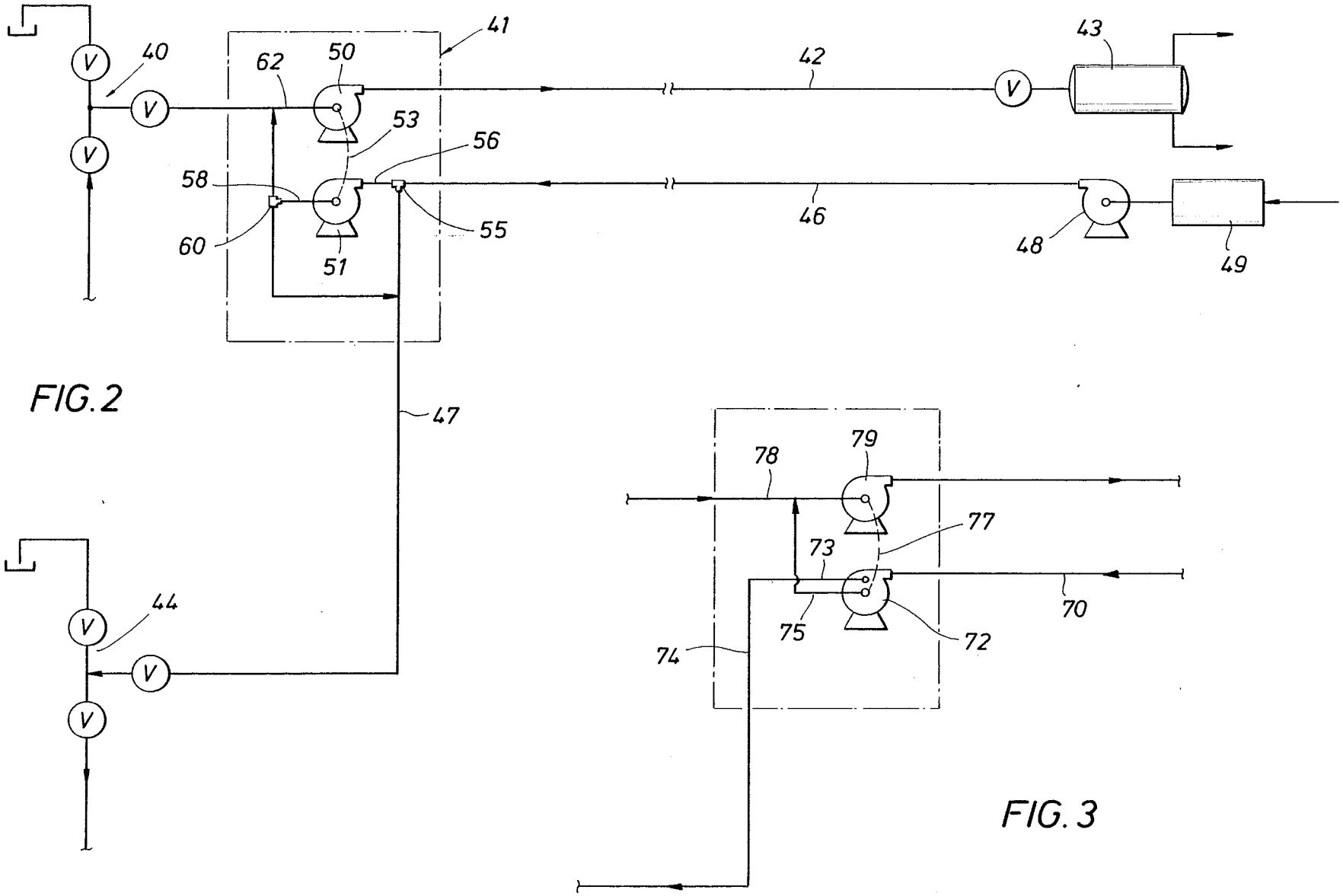
FIG. 2 shows an embodiment of the apparatus of the invention where the fluid motor is powered by well injection water.
FIG. 3 shows an embodiment of the apparatus where low pressure water is tapped :rom the fluid motor for injection into the pump.

FIG. 2 shows schematically an oil production system where well effluents are produced from a subsea production well 40 and pumped by a subsea booster station comprising a pumping apparatus according to the invention 41 via a subsea pipeline 42 to process facilities 43 on an offshore platform (not shown).

The process facilities may comprise an oil water separator train, degasifier and dewaxing facilities. Water is injected into the oil field via a subsea water injection well 44 which is linked via a first and a second water injection pipeline 46, 47, respectively, to a water injection pumping station 48. The water injection pumping station 48 is coupled to water treatment facilities 49 in which sea water is suitably purified before transferring it to the water injection well 44.

The pumping apparatus 41 comprises a rotary pump 50 and a fluid motor 51 of the turbine type which are mounted on a single shaft, schematically represented by phantom line 53.

The pumping apparatus 41 further comprises first regulating device 55 which separates the flow of injection water from the first water injection pipeline 46 into two streams one of which feeding the water injection well 44 via the second water injection pipeline 47 and another stream feeding the fluid motor 51 via a water inlet 56 thereof. The motor exhaust water is discharged via a water outlet 58. The water outlet 58 comprises a second regulating device 60 which exhausts all or part of the exhaust water into the pump inlet 62, whereas it injects the remaining exhaust water into the second water injection pipeline 47. The configuration of the pumping apparatus shown in FIG. 2 is attractive in a situation where large quantities of injection water are injected into an oil field, whereas only a minor portion of the flow of injection water is necessary to activate the fluid motor 51 and to be mixed up with the well effluents. An advantage of tapping the water from the outlet of the turbine motor 51 is that at this location the water has a lower pressure than at the inlet of the turbine motor, so that it is avoided that pressurized water is injected into the pump inlet 62 which would reduce the productivity of the well 40. The two regulating devices 55 and 60 may be piloted by control means which are actuated by the gas-liquid ratio at the pump inlet 62, the rotational speed of the shaft 53 and the flow rate of the well effluents.

FIG. 3 shows an alternative configuration of the pumping apparatus according to the invention. In this configuration all of the injection water injected via a first water injection pipeline 70 is fed to the turbine motor 72 of the apparatus. Part of the injected water is discharged from the turbine motor via a first water outlet 73 which taps the water at a suitably located point in the turbine motor and feeds the water injection well via a second water injection pipeline 74, whereas the remaining injected water is discharged from the turbine motor via a second water outlet 75 and feeds the water to the fluid inlet 78 of the pump 79. An advantage of tapping the water from a suitably located point in the turbine is that the power fluid is at high pressure which is advantageous for water injection purposes. A regulating device (not shown) will control the amount of fluid injected in the pump inlet 78.

Figure 4:
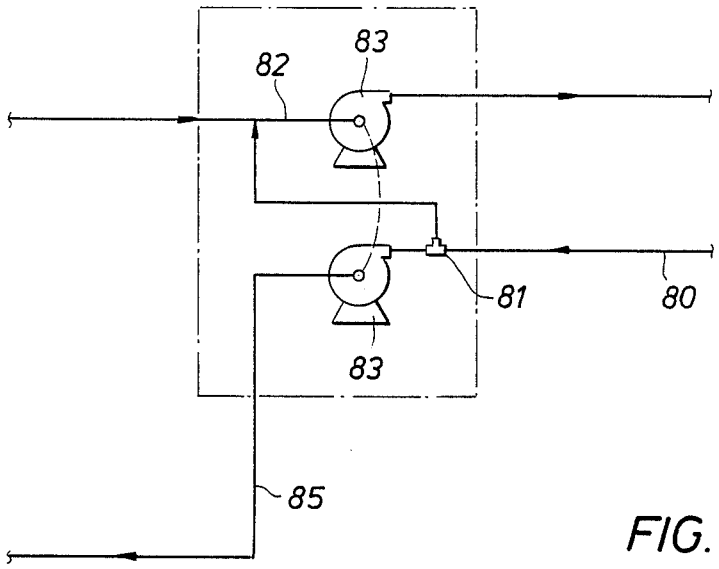
FIG. 4 shows an embodiment of the apparatus where water is tapped from the inlet of the motor for injection into the pump.

FIG. 4 shows yet another embodiment of the apparatus according to the invention. In this configuration part of the injection water is tapped from a first water injection pipeline 80 by a regulating device 81 which feeds the tapped water to the inlet 82 of the pump. The remaining water is fed to the turbine motor 83 and injected via second water injection pipeline 85 into a water injection well (not shown). Thus it can be seen that there are various possible way to split the stream of injection water into a stream which is injected into the oil field and which may simultaneously be utilized to drive the pumping apparatus and into a stream which is injected into the well effluents to increase the liquid-gas ratio thereof.

It will be understood that the regulating device or devices for controlling the separation of the streams of injection water may be mounted outside the pumping apparatus or either in the base unit or in the cylindrical housing thereof. It is preferred to mount the regulating device in the cylindrical housing because the housing can easily be retrieved for maintenance and repair.

It will further be understood that during production of well effluents from an offshore oil field in which water is injected to boost the oil recovery, use of injection water to drive the pumping apparatus provides significant cost savings in view of the absence of a separate link between the platform and the subsea production well to supply energy to the apparatus. It will further be appreciated that the injection water may contain surfactants or additives such as de-emulsifier. However, it is important that the water is suitably treated before mixing it up with the well effluents because the presence of untreated seawater in the well effluents could cause excessive corrosion of and scale deposits in the pump, the pipeline, the oil-water separator and other processing equipment.

Figure 5:
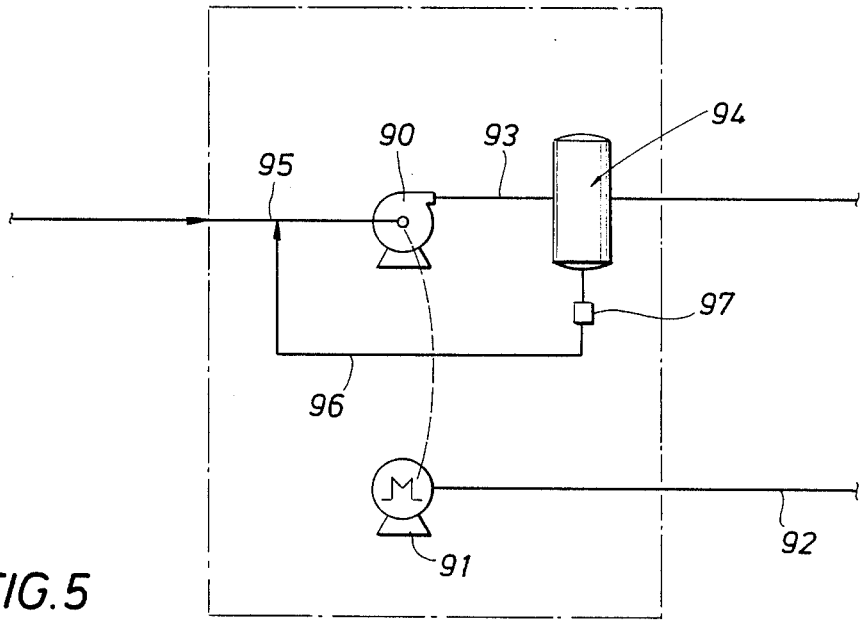
FIG. 5 shows an embodiment of the apparatus where some liquids are extracted from the pumped fluids by means of a liquid extractor and thereafter re-injected at the pump inlet thereby guaranteeing an appropriate liquid content at said pump inlet.

FIG. 5 shows a pump 90 powered by a motor 91. Power is supplied to the motor through power supply conduit 92. The motor 91 may be a turbine motor driven by gas injected into a well for providing a gas lift for raising well effluents to the surface. Some of the liquids exhausted from the pump are extracted from the multiphase flow at the pump outlet 93 by means of a liquid extractor 94 and injected in the pump inlet 95 by means of a liquid feed-back loop 96. The liquid flow in that loop is controlled by a regulating device 97. Thus it can be seen that even without mixing water with produced well effluents, the pump can be fed with a fluid of a suitable gas-liquid ratio. This option is particularly attractive when there is gas injection and no water injection in the considered field.

The pumping apparatus according to the invention may be utilized in offshore and onshore oil production operations. A key feature of the apparatus is that it comprises a cylindrical pump-motor housing which can be easily retrieved from and inserted into a cup shaped base unit. Said retrieving and insertion operations may be carried out by remotely operated equipment, or by operating personnel without requiring access into the well or requiring time consuming well shut down and dismantling operations.

What is claimed is:

1. An apparatus for pumping well effluents through a flowline comprising:

a cylindrical housing having disposed therein a fluid motor and a rotary pump driven thereby said housing comprising a fluid passage interconnecting the fluid inlet of the motor and the fluid inlet of the pump;

a vertically oriented cup-shaped base unit in which said cylindrical housing is retrievably secured such that a space is left therebetween;

a plurality of sealing means for dividing said space into at least three hydraulically separated sections, a first of said sections providing fluid communication between an end of an effluent feed conduit passing through the wall of said base unit and an effluent inlet of said pump passing through said housing, a second of said sections providing fluid communication between an end of an effluent exhaust conduit passing through the wall of the base unit and an effluent outlet of said pump passing through said housing, and a third of said sections providing fluid communication between an end of a power liquid feed conduit passing through the wall of said base unit and a fluid inlet of said motor passing through said housing.

2. An apparatus for pumping well effluents through a flow-line comprising:

a cylindrical housing having disposed therein a fluid motor and a rotary pump driven thereby;

a vertically oriented cup-shaped base unit in which said cylindrical housing is retrievably secured such that a space is left therebetween;

a plurality of sealing means for dividing said space into at least three hydraulically separated sections, a first of said sections providing fluid communication between an end of an effluent feed conduit passing through the wall of said base unit and an effluent inlet of said pump passing through said housing, a second of said sections providing fluid communication between an end of an effluent exhaust conduit passing through the wall of the base unit and an effluent outlet of said pump passing through said housing, and a third of said sections providing fluid communication between an end of a power liquid feed conduit passing through the wall of said base unit and a fluid inlet of said motor passing through said housing; and a liquid extractor connected to the effluent outlet of the pump, and a liquid feed back conduit arranged between the liquid extractor and the effluent inlet of the pump.

3. The apparatus of claim 1 or claim 2 wherein said space is divided by said sealing means into four hydraulically separated sections, the fourth of said sections providing fluid communication between an end of a power liquid exhaust conduit passing through the wall of said base unit and a fluid inlet of said motor.

4. The apparatus of claim 1 or claim 2 wherein said space is an annular space located between the cylindrical housing and the side wall of said cup-shaped base unit.

5. The apparatus of claim 4 wherein said sealing means comprises a series of sealing rings which are mounted on said cylindrical housing and which divide said annular space into a series of vertically spaced hydraulically separated sections.

6. The apparatus of claim 5, wherein said third section is located above said other sections of said annular space.

7. The apparatus of claim 6, wherein said power liquid feed conduit is connected to a water purification apparatus.

8. The apparatus of claim 3 wherein said power liquid exhaust conduit is connected to a water injection well.

9. The apparatus of claim 3 wherein said housing comprises a fluid passage interconnecting said fluid outlet of the motor and the fluid inlet of the pump.

10. The apparatus of claim 1 wherein said fluid passage comprises a fluid flow regulating device.

* * * * *